US005318052A

United States Patent [19]

Ivanov

[11] Patent Number: 5,318,052

[45] Date of Patent: Jun. 7, 1994

[54] HAIR CURLING DEVICE

[76] Inventor: Yuri Ivanov, 2120 Cruger Ave., Bronx, N.Y. 10462

[21] Appl. No.: 57,627

[22] Filed: May 7, 1993

[51] Int. Cl.[5] ..... A45D 6/02

[52] U.S. Cl. ..... 132/237; 132/120; 132/238; 132/239; 15/206

[58] Field of Search ..... 132/107, 120, 122, 150, 132/161, 226, 237, 238, 239; 15/206

[56] References Cited

U.S. PATENT DOCUMENTS

| | | | |
|---|---|---|---|
| 1,759,265 | 5/1930 | Kunin et al. | 132/238 |
| 2,112,195 | 3/1938 | Hertzberg | 15/206 |
| 2,207,427 | 7/1940 | Behr | 132/120 |
| 2,226,318 | 12/1940 | Nelson | 132/120 |
| 2,531,239 | 11/1950 | Twitty | 132/120 |
| 2,617,432 | 11/1952 | Hertzberg | 132/120 |
| 2,701,572 | 2/1955 | Resnick | 132/120 |
| 2,829,656 | 4/1958 | Pecovsky | 132/122 |
| 2,972,157 | 2/1961 | Peterson | 15/206 |
| 3,426,766 | 2/1969 | Castellano | 132/239 |
| 3,760,449 | 9/1973 | Swanson | 15/206 |

FOREIGN PATENT DOCUMENTS

| | | | |
|---|---|---|---|
| 711531 | 6/1965 | Canada | 132/161 |
| 728741 | 12/1942 | Fed. Rep. of Germany | 132/120 |
| 1235622 | 5/1960 | France | 132/161 |
| 354209 | 6/1961 | Switzerland | 132/226 |

*Primary Examiner*—Gene Mancene
*Assistant Examiner*—Frank A. LaViola
*Attorney, Agent, or Firm*—I. Zborovsky

[57] ABSTRACT

A hair-curling device has a plurality of substantially cylindrical handleless elements of different diameters each having a central supporting member and a plurality of radially extending bristles. One end of each element can have a hair-separating member, while the other end can have a holding member connectable with a handle. The elements can be arranged radially in engagement with each other to form an oval curl and releasably attached to each other.

17 Claims, 2 Drawing Sheets

HAIR CURLING DEVICE

BACKGROUND OF THE INVENTION

The present invention relates to a hair-curling device including a plurality of substantially round hair-curling elements.

Hair-curling devices of the above-mentioned general . type are known in the art. One known device includes a plurality of handleless rollers, while another device has a plurality of brushes provided with handle. Some of the known devices are disclosed for example in U.S. Pat. Nos. 3,967,630, 4,004,595, 4,260,871, 4,712,570. The devices of the above mentioned types have certain disadvantages. They are relatively difficult to use and special skills are needed for curling the client's or user's own hairs. A single set does not fit for any hair length and texture. The curling and processing of locks is time consuming. Since the elements have handle, they have a substantial weight (brushes). Also they have to be fixed to the hair by additional fixing elements. It is difficult to make curls of different especially oval shape.

SUMMARY OF THE INVENTION

Accordingly, it is an object of the present invention to provide a hair-curling device which avoids the disadvantages of the prior art.

In keeping with these objects and with others which will become apparent hereinafter, one feature of the present invention resides, briefly stated, in a hair-curling device which has a plurality of hair-curling substantially cylindrical elements each having a central elongated supporting element and a plurality of radially extending bristles and each being handleless.

When the hair-curling device is designed in accordance with the present invention, it avoids the disadvantages of the prior art and provides for highly advantageous results which will be explained in details later on.

The novel features of the present invention are set in particular in the appended claims. The invention itself, however, both as to its construction and its manner of operation will be best understood from the following description of preferred embodiments, which is accompanied by the following drawings.

DESCRIPTION OF PREFERRED EMBODIMENTS

Figure 8:
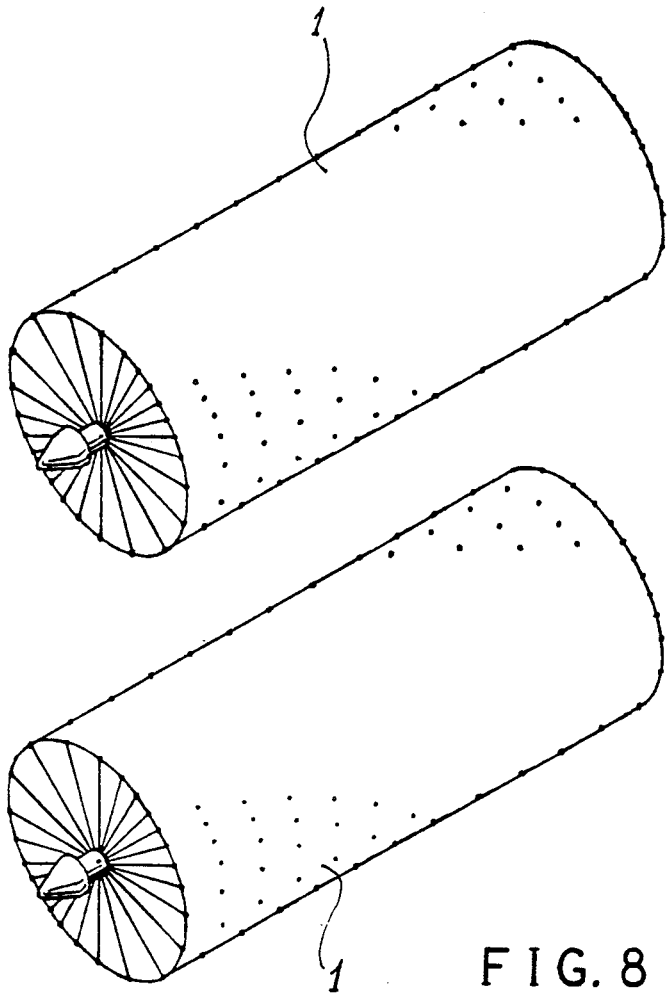
FIG. 8 is a view schematically showing several different hair-curling elements of the inventive device.

As shown in FIG. 8, a hair-curling device has a plurality of hair-curling elements of different diameters, for example four elements of different diameters, each identified with reference numeral 1.

Each hair-curling element 1 has a central elongated supporting part 2 formed by example by intertwisted wires and a plurality of bristles extending substantially radially and composed for example of plastic material. The bristles are identified as 3 and can include bristles of different radial length. The bristles can include at least one group of shorter regular bristles 4 and another smaller group of radially longer bristles 5 which extend radially outwardly beyond the bristles 4 and have non-sharp ends, formed for example by thickenings 6. As a result, the elements 1 are held on the hair without additional fixing or clamping elements One axial end of each element 1 is provided with a hair-separating member 7 formed as a conical projection. Another axial end of the element 1 is provided with a substantially hollow holding member 8. The holding member has a central portion connected with the end of the central supporting part of the element, and cavities at both sides of the central portion. It is also provided with a groove 9 on its peripheral surface.

A handle 10 can be connected to each of the elements 1 releseably. For this purpose, the handle has an inner hole 11 in which the holding member 8 can be received, and two spring-biased pins 12 extending radially inwardly into the hole 11. The left end of the handle and the hole 11 have an oval cross section which corresponds to the oval cross section of the holding member 8. For connecting the handle to the element, the element 1 is inserted by its holding member 8 into the hole 11 of the handle 10, and the pins 12 snap into the annular groove 9 of the holding member. The handles are used for the element 1 of a great diameter or for a combining element which will be explained hereinbelow.

Figure 9A:
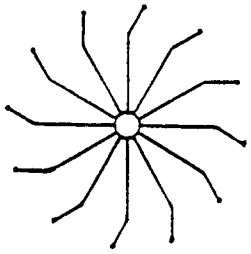
FIGS. 9*a*–9*c* show elements with different bristles.
Figure 9B:
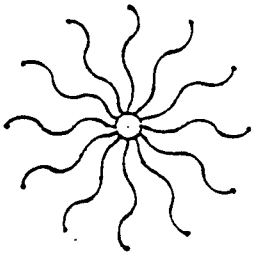
Figure 9C:
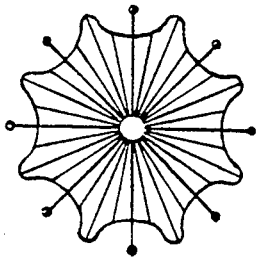

The diameters of the elements 1 are selected so as to cover all possible ranges of lengths of hair: from the shortest to the longest. Bristles of different shapes can be used as shown in FIGS. 9*a*–9*c*.

Figure 1:
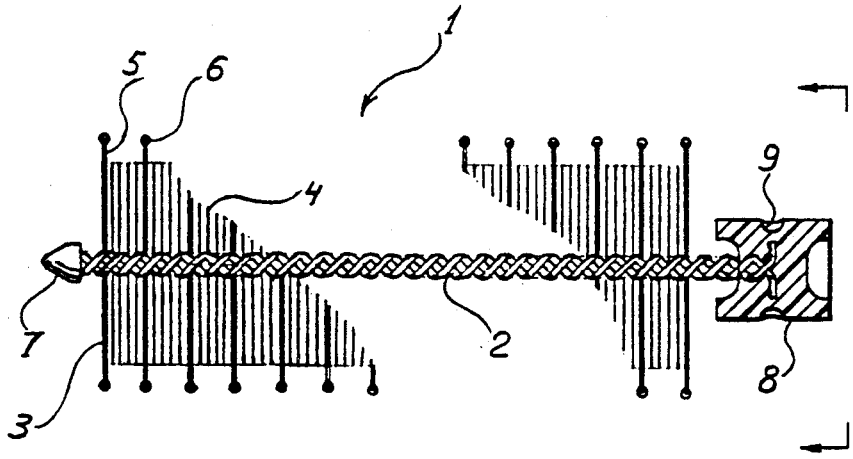
FIG. 1 is a side view of a hair-curling element of inventions.
Figure 2:
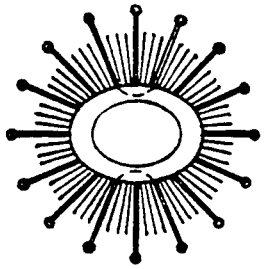
FIG. 2 is an end view of the hair-curling element of FIG. 1.
Figure 4:
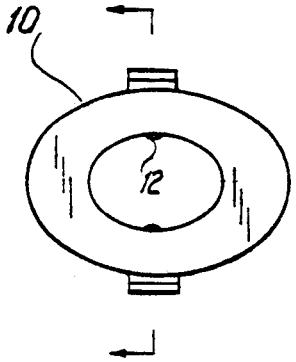
FIG. 4 is an end view of the handle for the hair-curling element, of FIG. 3.
Figure 3:
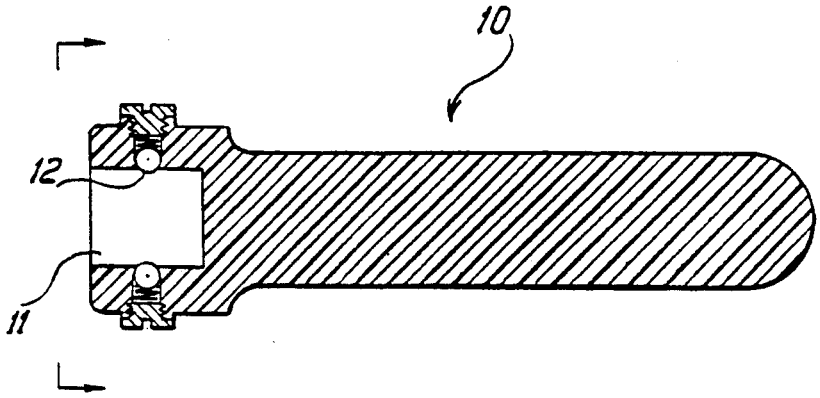
FIG. 3 is a side view of a handle for the hair-curling element of the inventive device.
Figure 6:
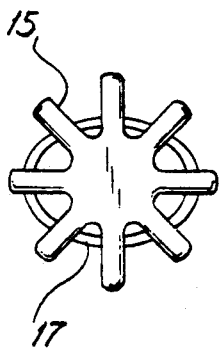
FIG. 6 is an end view of the combining element of FIG. 5 for the inventive device.
Figure 5:
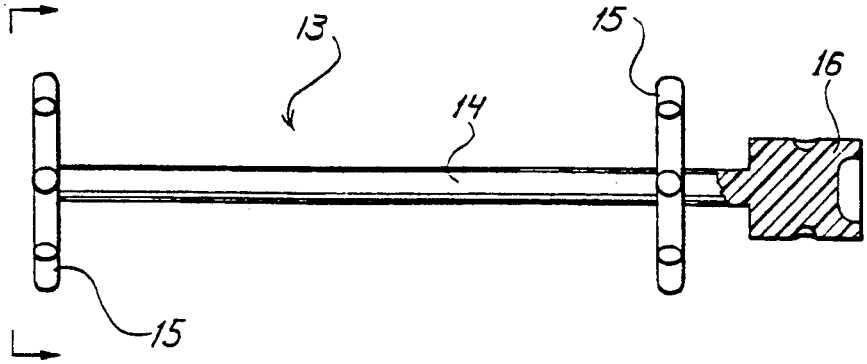
FIG. 5 is a side view of a combining element of the inventive hair-curling device.
Figure 7:
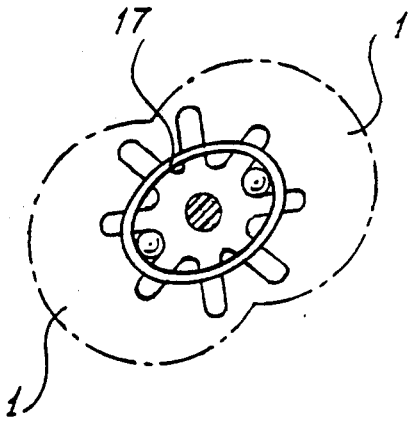
FIG. 7 is a side view of several hair-curling elements combined with one another.

The elements 1 can be combined with each other by arranging them coaxially and parallel to one another so that their bristles engage in each other. A combining element 13 is provided for this purpose. It has a central support 14 and two multi-leg stars 15 at its ends, as well as a holding member 16 similar to the holding member 8. As shown in FIG. 7, two elements 1 are combined by assembling them on the combining element 13. In particular, the central supporting parts of the elements 1 engage in two gaps between two corresponding legs of the stars 15 of the combining element 13 and pressed toward one another by an elastic member 17, for example a band. The thusly assembled device has an oval shape and can be used for making oval curls. In particular, since the elements 1 in FIG. 7 have different diameters, the device assumes a pear-like shape to make corresponding curls. In the assembled condition of two elements 1, the combining element 13 can be connected with the handle for convenience of manipulations. When three elements are combined, an irregular shape of curls can be obtained and the curls have a greater radius. With the combination of four elements 1, the radius of the curls can be further increased.

The device in accordance with the present invention is used in the following manner.

A desired number of the elements 1 of a required diameter are placed on dry or wet hair, using the hair-separating members for separation of locks and the holding members for turning the elements 1. If the hair are dense and long, or if several elements 1 with the combining element 13 are used, then the handle 8 is utilized. The hair which are curled on the elements 1 are heated (if they were dry) or dried (if they were wet), and some time (1–2 min) is given for cooling down. When working with the elements 1, it is not necessary to work with the whole head at once (contrary to the work with conventional rollers) or to work only with one lock (contrary to the work with conventional brushes provided with handles). Instead a smooth, transitional method is utilized: The elements 1 such as No. 1 and No. 2 are curled over and heated. The elements No. 3 and No. 4 are curled over and heated. The elements Nos. 5 and 6 are curled over, and heated, in a sonsecutive order. At this time the elements Nos. 1 and 2 are already cooled down and can be removed. Then again the elements Nos. 1 and 2 can be curled over, etc.

The number of the elements 1 in the cycle can be varied in dependence upon wetness, density and length of hair. When the device is used for completely dry hair, then after curling it is desirable to apply hair spray to the hair.

The elements 1 of the inventive device have low weight since they do not have handles, and as a result of their low weight they are firmly retained on both wet hair and dry hair without auxiliary fixing devices. They allow to treat several locks of hair simultaneously much faster, even in home condition. They also allow combining of several elements in a unit in order to increase a diameter and change a shape (provide oval shape) of curls. The device is easy to use and does not require special skills for curling of customer's hair or user's own hair. The same device is suitable for hair of any length and texture. The curking and treatment of locks is performed fast.

The invention is not limited to the details shown since various modifications and structural changes are possible without departing in any way from the spirit of the invention.

What is desired to be protected by Letters Patent is set forth in the appended claims.

I claim:

1. A hair-curling device, comprising a plurality of hair-curling elements each being handleless and each having a central elongated supporting part and a plurality of bristles extending substantially radially from said central supporting part; a holding member provided at an end of said central supporting part; a handle connectable with said holding member releasably so as to be connected with and disconnected from the latter when needed; and means for releasably connecting said handle with said holding member and including a groove formed on an outer surface of said holding member and a spring-biased projection provided in said handle and engageable in said groove in assembled condition.

2. A hair-curling device as defined in claim 1, wherein said bristles extend so as to form together a substantially cylindrical outer surface.

3. A hair-curling device as defined in claim 1, wherein said central supporting part has two ends spaced from one another in direction of elongation; and further comprising hair-separating means provided at one of said ends of said central supporting part.

4. A hair-curling device as defined in claim 1, wherein said hair-separating means includes a substantially conical projecting member extending from said one end of said central supporting part in direction of elongation of the latter.

5. A hair-curling device as defined in claim 1, wherein said central supporting member is formed of a twisted wire, while said bristles are composed of plastic.

6. A hair-curling device as defined in claim 1, wherein said bristles of each of said elements include bristles of different radial length.

7. A hair-curling device as defined in claim 6, wherein said bristles include at least one group of bristles of a predetermined length, and another group of bristles which have a greater length and a non-sharp free end.

8. A hair-curling device as defined in claim 1, wherein said elements are arrangeable relative to one another so that their bristles engage in each other; and further comprising means for releasably attaching said elements with one another in an arranged condition.

9. A hair-curling device as defined in claim 1, wherein said elements have elements of different diameters.

10. A hair-curling device as defined in claim 1;

and further comprising a combining element for supporting and combining said hair-curling elements with one another when the latter extend substantially parallel to one another.

11. A hair-curling device, comprising a plurality of hair-curling elements each being handleless and each having a central elongated supporting part and a plurality of bristles extending substantially radially from said central supporting part, said elements being arrangeable relative to one another so that their bristles engage in each other; and means for releasably attaching said elements with one another in an arranged condition, said attaching means including an elastic member arranged to surround and press toward one another said central supporting parts of said elements in the arranged condition.

12. A hair-curling device as defined in claim 11;

and further comprising a holding member provided at an end of said central supporting part.

13. A hair-curling device as defined in claim 12, wherein said holding member is substantially hollow and has a central portion connected with said central supporting part and two cavities at both sides of said central portion.

14. A hair-curling device as defined in claim 12;

and further comprising a handle connectable with said holding member releasable so as to be connected with and disconnected from the latter when needed.

15. A hair-curling device as a defined in claim 12, wherein said holding member of each of said elements has an oval cross-section.

16. A hair-curling device, comprising a plurality of hair-curling elements each being handleless and each having a central elongated supporting part and a plurality of bristles extending substantially radially from said central supporting part; and a combining element for supporting and combining said hair-curling elements with one another when the latter extend substantially parallel to one another, said combining element having a central elongated support and at least one multi-leg star located at least at one end of said support so that said central supporting part of each of said hair-curling elements can engage in a gap between two neighboring legs of said star.

17. A hair-curling device as defined in claim 16, wherein said central support has a holding member, each of said hair-curling elements having a holding member identical to said holding member of said central support of said combining element; and further comprising a handle releseably connectable with each of said holding members.

* * * * *